US008624565B2

(12) United States Patent
Brueckl et al.

(10) Patent No.: US 8,624,565 B2
(45) Date of Patent: Jan. 7, 2014

(54) ON-LOAD TAP CHANGER COMPRISING SEMICONDUCTOR SWITCHING ELEMENTS

(75) Inventors: Oliver Brueckl, Waldmuenchen (DE); Dieter Dohnal, Lappersdorf (DE); Hans-Henning Lessmann-Mieske, Neutraubling (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 270 days.

(21) Appl. No.: 13/141,107

(22) PCT Filed: Feb. 6, 2010

(86) PCT No.: PCT/EP2010/000750

§ 371 (c)(1),
(2), (4) Date: Jul. 28, 2011

(87) PCT Pub. No.: WO2010/115485

PCT Pub. Date: Oct. 14, 2010

(65) Prior Publication Data

US 2012/0032654 A1 Feb. 9, 2012

(30) Foreign Application Priority Data

Apr. 9, 2009 (DE) ..... 10 2009 017 196

(51) Int. Cl.
*G05F 1/70* (2006.01)

(52) U.S. Cl.
USPC ..... 323/211; 323/258

(58) Field of Classification Search
USPC ..... 323/205, 207, 209, 211, 216, 224, 225, 323/258, 301, 340, 343, 362; 307/75, 85, 307/113, 134, 137, 104, 112; 363/16, 17, 363/89, 97
See application file for complete search history.

(56) References Cited

U.S. PATENT DOCUMENTS

| | | | | |
|---|---|---|---|---|
| 3,725,833 | A * | 4/1973 | Thomas | 336/146 |
| 4,978,815 | A | 12/1990 | Berger | |
| 6,351,106 | B1 * | 2/2002 | Kramer et al. | 323/258 |
| 6,525,951 | B1 * | 2/2003 | Paice | 363/154 |
| 6,856,122 | B2 | 2/2005 | Dohnal | |
| 6,924,631 | B2 * | 8/2005 | Hauer | 323/255 |
| 7,656,138 | B2 * | 2/2010 | Dohnal | 323/258 |

FOREIGN PATENT DOCUMENTS

EP 0124904 A 11/1984

* cited by examiner

*Primary Examiner* — Rajnikant Patel
(74) *Attorney, Agent, or Firm* — Andrew Wilford

(57) ABSTRACT

The invention relates to an on-load tap changer comprising semiconductor switching elements for uninterrupted switching between fixed tap changer contacts which are electrically connected to winding taps of a tapped transformer. Each of the fixed tap changer contacts can be connected to a charge diverter either directly or, during switching, via the semiconductor switching elements that are connected therebetween. According to the invention, the charge diverter has fixed, divided diverting contact pieces in order for the semiconductor switching elements to be electrically isolated from the transformer winding during stationary operation.

9 Claims, 3 Drawing Sheets

ON-LOAD TAP CHANGER COMPRISING SEMICONDUCTOR SWITCHING ELEMENTS

CROSS REFERENCE TO RELATED APPLICATIONS

Figure 1:
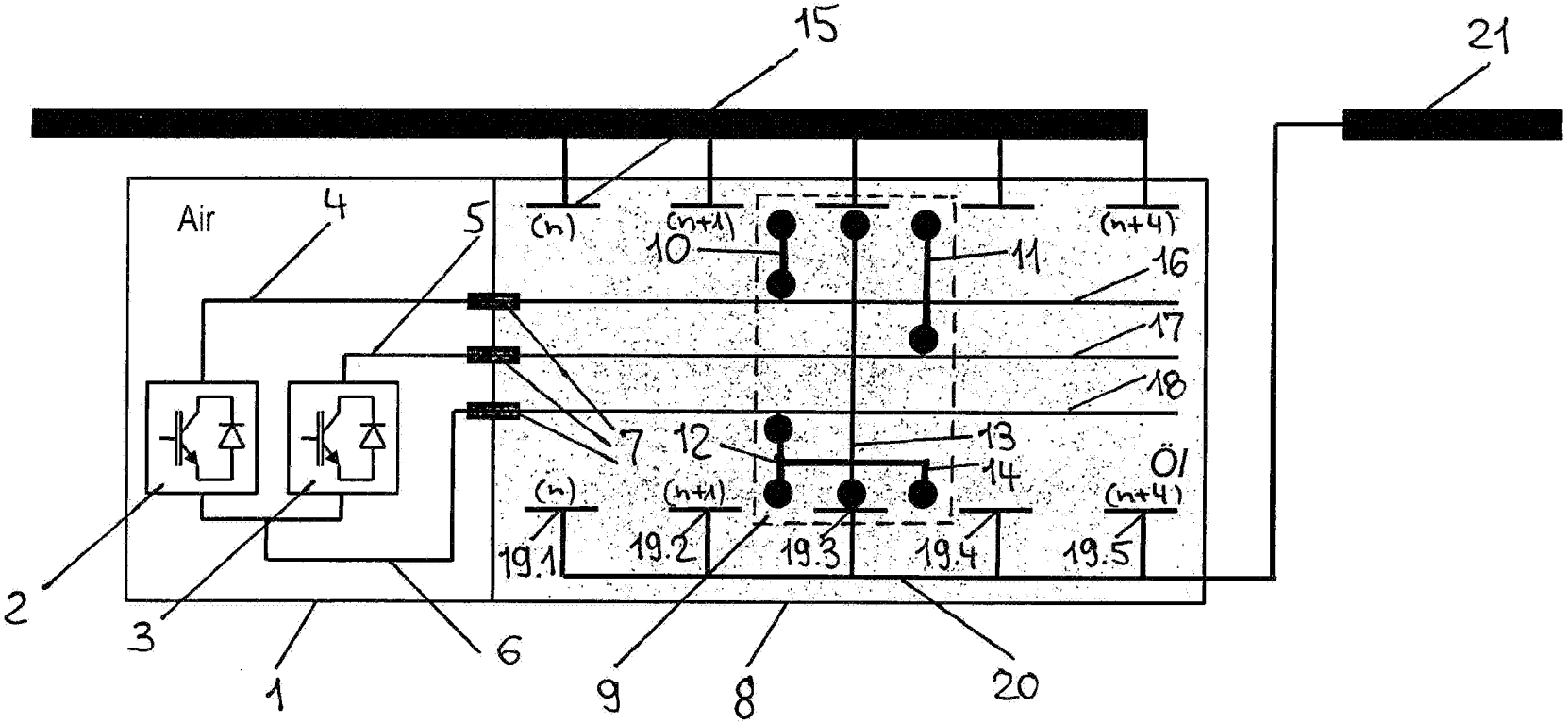

This application is the US national phase of PCT application PCT/EP2010/000750, filed 6 Feb. 2010, published 14 Oct. 2010 as 2010/115485, and claiming the priority of German patent application 102009017196.7 itself filed 9 Apr. 2009, whose entire disclosures are herewith incorporated by reference.

The invention relates to a tap changer with semiconductor switching elements for uninterrupted switching over between winding taps of a tapped transformer. In that case the invention proceeds from a tap changer in accordance with the principle of an on-load tap changer.

Tap changers are known in various forms of embodiment; they can, in principle, be differentiated as on-load tap changers and apparatus with separate selectors for power-free selection of the new winding tap which is to be switched over to and separate on-load tap changers for the subsequent actual switching over. A good overview with respect to the various forms of construction is offered by the publication Axel Krämer: On-Load Tap-Changers for Power Transformers, MR publication, 2000. The details are is explained on page 7f there. Regardless of the form of construction, all tap changers have a common load shunt which independently of the instantaneous setting of the tap changer produces a connection with the transformer, as a rule the main winding.

For example, a tap changer is known from WO 99/60588, which, as is generally customary in accordance with the prior art, contains such a single load shunt. In the known solution this load shunt is constructed as an electrically conductive shunt ring concentrically surrounding a switch column. A part of a contact bridge wipes the shunt ring and the other part of the contact bridge electrically contacts the respective fixed tap contact.

A quite similar arrangement of a tap changer is already known from DE 38 33 126 A1. FIG. 4 in particular, there, shows a continuous shunt, here in schematic illustration.

For tap changers with mechanical contacts or also with vacuum switching cells as switching means these continuous shunt rings or, in the case of linear actuation of the tap changer, also shunt rails are not problematic; they make possible a constructionally simple format. Thereagainst, various disadvantages arise for tap changers with semiconductor switching elements. Due to the constant application of the operating voltage and the loading of the electronic power system by lightning shock voltage high insulation spacings are required, which is undesirable. Moreover, expensive high-voltage conduits through the transformer wall are needed. Overall, the known load shunts lead to a constant loading of the components of the electronic power system.

The object of the invention is to eliminate these is disadvantages and to indicate a tap changer with semiconductor switching elements which avoids the high loading of the switching elements and in static operation ensures an electrical separation of the tap changer from the transformer winding.

This object is fulfilled by a tap changer according to category with the features of the first patent claim. The subclaims relate to advantageous developments of the invention.

The particular advantage of the solution according to the invention resides in the fact that in static operation all connecting lines of the components of the electronic power system are electrically separated from the transformer winding.

The components of the electronic power system are thus reliably separated from lightning shock voltage and also from permanent loading by the operating voltage. Only during the switch-over phase, thus the actual load changeover, is there an electrical connection with the transformer winding.

Figure 2:
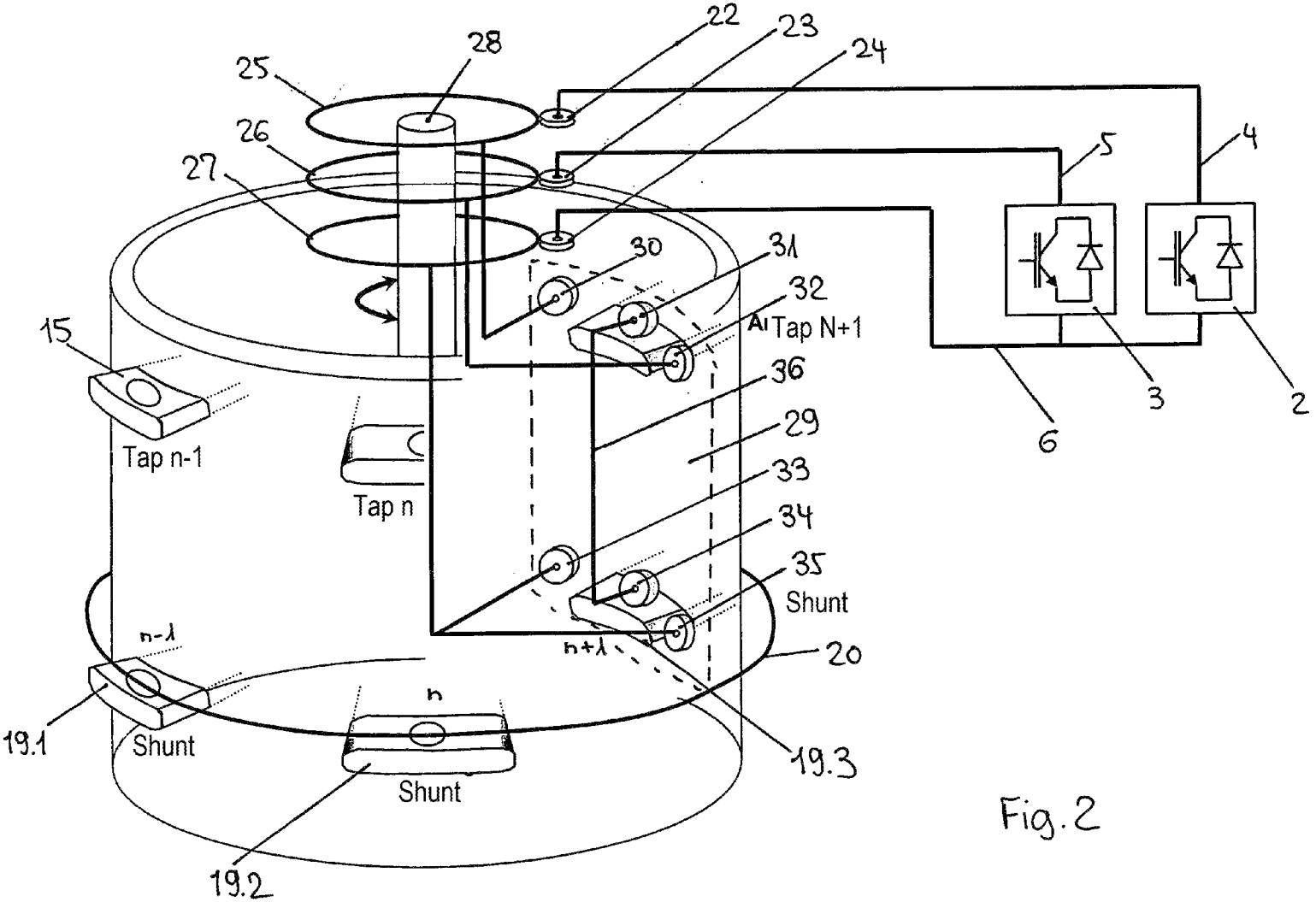
Figure 3:
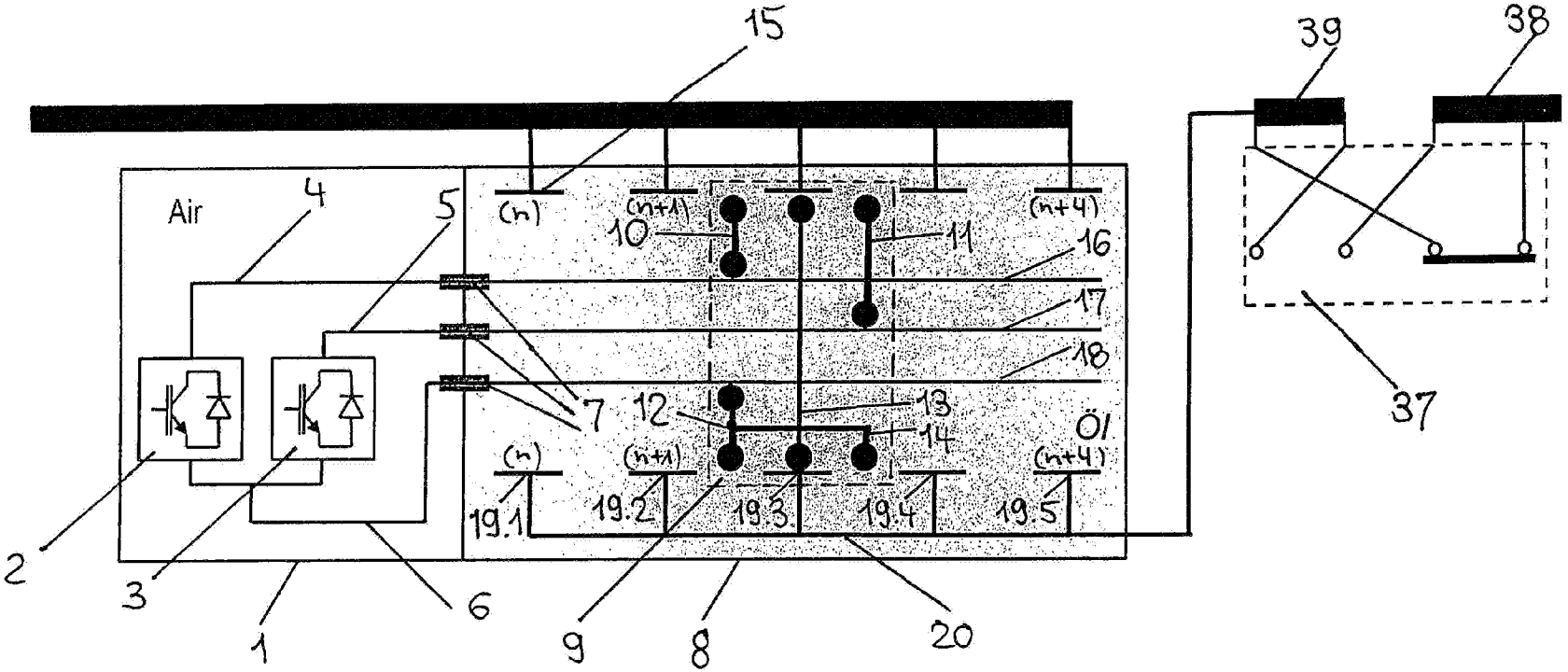

The invention is explained in more detail in the following on the basis of exemplifying embodiments, in which:

FIG. 1 shows a tap changer according to the invention in schematic illustration, FIG. 2 shows a further form of embodiment of a tap changer according to the invention, and FIG. 3 shows a tap changer according to the invention in a differing connection with the transformer.

A tap changer comprising a power-electronic on-load tap changer 1 is shown in FIG. 1. In that case two semiconductor switches 2 and 3 are provided, which have a respective electrical input 4 or 5 and a common electrical output 6. The on-load tap changer 1 thus consists of two current paths; one for the side to be switched off and one for the side taking over, respectively is realized by a semiconductor switch 2 or 3. The electrical inputs 4, 5 as well as the electrical output 6 are guided by means of conduits 7 in a mechanical contact system 8. The mechanical contact system 8 comprises a contact carriage 9 which is indicated in the FIG. merely by a dashed line. The contact carriage 9 comprises contact bridges 10, 11, 12, 13 which are fixedly arranged thereon. The contact bridges 10 to 13 are electrically conductive, but insulated relative to one another; they have at the ends thereof contact rollers, wiper arrangements or comparable means, which are known per se and which are shown only schematically in the figure. The contact bridges 10 to 13 as well as an additional articulated further contact roller 14 are discussed later in more detail. Each of the tap contacts 15 illustrated in FIG. 1 corresponds with a winding tap n, n+1, . . . , of the regulating winding of the tapped transformer.

In addition, provided in the mechanical contact system are three contact rails 16, 17, 18 which are each electrically conductive and which are electrically connected respectively with the electrical input 4, the electrical input 5 and the electrical output 6 of the semiconductor switches 2, 3.

According to the invention the load shunt is divided, i.e. it is not a continuous shunt rail or the like known from the prior art. Instead, individual shunt contacts 19.1, 19.2, 19.3, 19.4, 19.5 are arranged here and as seen in movement direction of the contact carriage 9 correspond in their length with the fixed tap contacts 15. In other words: position and dimensioning of the shunt contacts 19.1 to 19.5 correspond, in another horizontal plane, with the position and dimensioning of the fixed tap changer contacts 15. In the case of the form of embodiment shown here the contact rails 16 to 18 and the individual shunt contacts 19.1 to 19.5 are led parallel to one another; the contact carriage 9 in this regard executes a linear, translational movement for contact-making. The individual shunt contacts 19.1 to 19.5 are connected together by way of an electrical connection, i.e. a shunt 20, and led to the main winding 21. The shunt connection 20 can be carried out not only within, but also outside the tap changer.

The first contact bridge 10 can be connected at one free end thereof with the tap changer contacts 15 and at the other free end thereof it runs on the contact rail 16, which is electrically connected with the input 4 of the first semiconductor switch 2. The second contact bridge 11 can be similarly connected at one free end thereof with the fixed tap changer contacts 15 and at the other free end thereof it runs on the further contact rail 17, which is electrically connected with the input 5 of the second semiconductor switch. The third contact bridge 12 runs by one free end thereof on the contact rail 18, which is electrically connected with the common electrical output 6 of the power-electronic power switch. Its other free end corresponds with the shunt contacts 19.1 to 19.5. Provided physically between the two mentioned contact bridges 10 and 11 is the further contact bridge 13, i.e. the shunt contact bridge, which can be contacted at one free end with the fixed tap changer contacts 15 and at the other free end thereof with the shunt contacts 19.1 to 19.5. In addition, arranged symmetrically with respect to the described contact bridge 12 is the roller contact 14, which is electrically connected with the contact bridges 12 and 13 and can similarly be connected with the shunt contacts 19.1 to 19.5.

It can be seen that not only the contact bridge 12 and thus the common output 6 of the power-electronic on-load tap changer, but also the contact bridge 13 can be brought into electrical contact with one of the shunt contacts 19.1 to 19.5 depending on the respective setting of the switching carriage 9. In static operation the contact bridge 13 takes over the direct electrical connection between the respectively connected tap changer contact 15 and the respective shunt contact; this is one of the shunt contacts 19.1 to 19.5 depending on the respective switch setting. The contact bridges 10 and 11 which lead to the inputs of the power-electronic on-load tap changer 1 are, thereagainst, not connected; the semiconductor switches 2 and 3 are switched to be free.

In the case of a load changeover the contact carriage 9 is moved to the left or right depending on whether switching is to be in the direction of 'higher' or 'lower'. As a consequence, one of the two contact bridges 10 and 11 runs onto the tap changer switch contact 15 to be newly connected and thus produces an electrical connection with the corresponding input 4 or 5 of the respective semiconductor switch 2 or 3. At the same time the contact bridge 13 comes out of contact with one of the fixed tap changer contacts 15.

The switching over is concluded when the contact carriage 9 has been moved onward to such an extent that the contact bridges 10 and 11 are both brought out of engagement again and the contact bridge 13 has again taken over constant current conduction.

FIG. 2 shows a further form of embodiment of the invention with a circular arrangement. Here, too, semiconductor switches 2 and 3 are provided, which each have a separate electrical input 4 or 5 and a common electrical output 6. In this regard, contact rollers 22, 23, 24 are provided which each run on a respective contact ring 25, 26, 27. These contact rings 25 to 27 correspond with respect to the function thereof with the contact rails 16 to 18 of FIG. 1. The fixed tap changer contacts 15 are here provided on a concentric circle. The central switch shaft 28 is illustrated. In addition, shunt contacts 19.1 to 19.3 are shown here. These shunt contacts 19.1 to 19.3 are arranged in a horizontal plane different from the fixed tap changer contacts 14. However, they have the same contact geometry and also vertical arrangement as the fixed tap changer contacts 15.

In addition, a switching segment 29 of insulating material which is indicated only by dashed line is provided and for load changeover is rotatable by the switch shaft 28 through an angle which corresponds with the spacing between the two fixed tap changer contacts 14 or two shunt contacts 19.1 . . . 19.3. Provided on the switching segment 29 in a first horizontal plane are contact rollers 30, 31, 32 which are contactable by the fixed tap changer contacts 15. In addition, provided in a second horizontal plane are further contact rollers 33, 34, 35 which are contactable with one of the shunt contacts 19.1 to 19.3 depending on the respective setting of the switching segment. The contact rollers 30 are electrically connected by way of the contact ring 25 with the input 4 of the first semiconductor switch 2. The contact roller 32 is electrically connected with the input 5 of the second semiconductor switch 3 by way of the contact ring 26. The lower contact rollers 33 and 35 are both connected by way of the contact ring 27 with the common output 6 of the two semiconductor switches 2 and 3. Finally, the upper contact roller 31 and lower contact roller 34 have an electrically conductive connection 36 of such a kind that the contact roller 31, which is physically arranged between the contact rollers 30 and 32, can be directly connected by way of the lower contact roller 34—dependent on setting—with one of the shunt contacts 19.1 to 19.3.

As explained, in this form of embodiment of the invention the switching segment 29 and with it the contact rollers 30 to 35 execute a rotational movement in each load changeover. However, the principle of function is the same: in static operation the is respectively connected fixed tap changer contact 15 is electrically connected directly with one of the shunt contacts 19.1 to 19.3 by way of the contact roller 34, whilst the semiconductor switches 2 and 3 are not only switched to be free, but also electrically separated form the transformer winding. Only in the case of a switching over, depending on the rotational direction, is in each instance one of the two inputs 4 and 5 of the power-electronic on-load changeover switch connected by means of the associated contact roller 30 or 32 briefly with the respective fixed tap changer contact 5 which is to be switched over to. At the same time, one of the contact rollers 33 and 35 then takes over, i.e. only during the switching over, in dependence on rotational direction the electrical connection with one of the shunt contacts 19.1 to 19.3.

FIG. 3 shows a changed connection of the tap changer according to the invention with the transformer. Here, a tap changer 37 which is known per se and which switches in current-free manner is additionally provided in the transformer. By means of this tap changer 37 winding parts 38 and 39 of the transformer can be differently connected for increasing the total available number of voltage steps.

In all forms of embodiment the described tap changer according to the invention has by comparison with the prior art the substantial advantage that all connecting lines to and from the power-electronic on-load tap changer are electrically separated from the transformer winding. The oil paths between the individual contact bridges and the individual contact members in that case take over the insulation between these components. The power-electronic on-load tap changer is in the case of the invention separated not only from lightning strike voltage, but also from constant loading by the operating voltage. Only during the actual load changeover, namely a switching-over phase in the time range of is approximately 100 ms, is there an electrical connection with the transformer winding and thus application of the operating voltage. The insulation of the passages 7 as well as the insulating spacings in air can be executed to be smaller by comparison with the prior art.

The invention claimed is:

1. A tap changer with semiconductor switching elements for uninterrupted switching over between fixed tap changer contacts electrically connected with winding taps of a tapped transformer, wherein the fixed tap changer contacts are arranged along a track, wherein a contact carriage is movable along the track, wherein arranged on the contact carriage are electrically conductive and mutually insulated contact bridges and, in turn electrically insulated relative thereto, two further, electrically interconnected contact bridges, by which contact bridges selectably in static operation one of the fixed tap changer contacts is directly connectable with a load shunt and during the changeover a respective one of the fixed tap changer contacts is temporarily connectable with an input of one of the semiconductor switches and in addition the output of the respective semiconductor switch is connectable with the load shunt, and wherein the load shunt comprises fixed, divided shunt contact members of such a kind that the semiconductor switching elements in static operation are electrically separated from the load shunt and thus from the transformer winding.

2. The tap changer according to claim 1, wherein fixed, divided shunt contact members are arranged in a further track parallel to the track of the fixed tap changer contacts and in the same three-dimensional and geometric pattern as these.

3. The tap changer according to claim 1, wherein the fixed tap changer contacts and the fixed shunt contact members are respectively arranged along a planar track and the contact carriage is linearly movable.

4. The tap changer according to claim 1, wherein the fixed tap changer contacts and the fixed shunt contact members are respectively arranged on a circular track concentrically about a fulcrum of the rotatable contact carriage.

5. The tap changer according to claim 1, wherein the semiconductor switching elements are IGBTs.

6. The tap changer according to claim 1, wherein the two semiconductor switching elements each have a separate electrical input and a common electrical output.

7. The tap changer according to claim 1, wherein electrically conductive, but mutually insulated contact rails, each of which is disposed in electric connection with one of the electrical inputs or with the electric output, are provided parallel to the track of the fixed tap changer contacts.

8. The tap changer according to claim 7, wherein the track of the shunt contact members is provided parallel to the contact rails and again electrically insulated relative thereto, the shunt contact members in turn being electrically connected with the load shunt.

9. The tap changer according to claim 1, wherein the contact bridges are arranged with such dimensioning and physical disposition on the contact carriage that they correspond with the contact rails or one of the shunt contact members, and producible through them in dependence on switching is or are an electrical connection selectably between one of the fixed tap contacts directly with one of the shunt contact members or an electrical connection between one of the fixed tap contacts and one of the electrical inputs as well as additionally an electrical connection between the electrical output and one of the shunt contact members.

* * * * *